US007628224B2

(12) United States Patent
D'Souza et al.

(10) Patent No.: US 7,628,224 B2
(45) Date of Patent: Dec. 8, 2009

(54) SHALLOW/INTERMEDIATE WATER MULTIPURPOSE FLOATING PLATFORM FOR ARCTIC ENVIRONMENTS

(75) Inventors: Richard D'Souza, Houston, TX (US); Drew Linden Krehbiel, Richmond, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 0 days.

(21) Appl. No.: 11/742,128

(22) Filed: Apr. 30, 2007

(65) Prior Publication Data

US 2008/0267716 A1 Oct. 30, 2008

(51) Int. Cl.
*E21B 7/12* (2006.01)

(52) U.S. Cl. ..... 175/5; 166/352; 166/358; 166/366; 114/144 B; 405/224.2

(58) Field of Classification Search ..... 175/5; 166/352–354, 358, 359, 366–369, 355; 405/224.2–224.4; 114/264, 144 B, 151
See application file for complete search history.

(56) References Cited

U.S. PATENT DOCUMENTS 3,335,690 A * 8/1967 Busking ..... 114/256
4,059,148 A 11/1977 Blomsma
4,604,961 A * 8/1986 Ortloff et al. ..... 114/230.12
4,618,286 A 10/1986 Michel et al.
4,666,340 A * 5/1987 Cox ..... 405/204
4,819,730 A * 4/1989 Williford et al. ..... 166/355
4,972,907 A * 11/1990 Sellars, Jr. ..... 166/353
5,065,689 A * 11/1991 Krogstad ..... 114/230.12
5,092,401 A 3/1992 Heynen
5,316,509 A * 5/1994 Boatman et al. ..... 441/3
5,486,070 A 1/1996 Huete
5,518,341 A 5/1996 Verret
5,762,279 A 6/1998 Horton, III
6,047,781 A * 4/2000 Scott et al. ..... 175/5
6,056,071 A * 5/2000 Scott et al. ..... 175/5
6,199,500 B1 * 3/2001 Børseth et al. ..... 114/230.12
6,203,247 B1 3/2001 Schellstede et al.
6,371,697 B2 4/2002 Huang et al.
6,453,838 B1 * 9/2002 Mowell et al. ..... 114/230.13
6,524,049 B1 2/2003 Minnes
6,811,355 B2 * 11/2004 Poldervaart ..... 405/169
6,840,322 B2 * 1/2005 Haynes et al. ..... 166/352
6,968,795 B2 * 11/2005 Lambregts et al. ..... 114/65 R (Continued)

*Primary Examiner*—Thomas A Beach
*Assistant Examiner*—Matthew R Buck
(74) *Attorney, Agent, or Firm*—Kellogg Brown & Root LLC

(57) ABSTRACT

A method and apparatus for conducting simultaneous drilling and production are provided. The apparatus can include a ship shape floating vessel, wherein the ship shape floating vessel includes at least two drilling derricks, at least two drilling modules, and at least one production module, all situated on the upper surface of the ship shape floating vessel. The drilling modules are adapted for conducting drilling operations; the production module is adapted for conducting production operations. The apparatus can include at least two marine risers, wherein each marine riser depends from a drilling or production module toward a hydrocarbon bearing zone or sea floor and is adapted for conducting drilling and/or production operations; at least one production turret located on the lower surface of the ship shape floating vessel; and at least one production riser, wherein the production riser depends from the production turret, extends toward the sea floor, and is adapted for conducting production operations.

18 Claims, 4 Drawing Sheets

U.S. PATENT DOCUMENTS

| | | | | |
|---|---|---|---|---|
| 6,968,900 | B2 | 11/2005 | Williams et al. | |
| 6,968,902 | B2 | 11/2005 | Fenton et al. | |
| 2004/0238176 | A1 * | 12/2004 | Appleford et al. | 166/353 |
| 2004/0244986 | A1 * | 12/2004 | Poldervaart et al. | 166/367 |
| 2005/0109537 | A1 | 5/2005 | Ayling | |
| 2005/0211440 | A1 * | 9/2005 | Lanfermeijer et al. | 166/352 |
| 2006/0070741 | A1 * | 4/2006 | Pollack et al. | 166/345 |
| 2006/0283590 | A1 * | 12/2006 | Poldervaart et al. | 166/265 |

* cited by examiner

SHALLOW/INTERMEDIATE WATER MULTIPURPOSE FLOATING PLATFORM FOR ARCTIC ENVIRONMENTS

CROSS REFERENCE TO RELATED APPLICATIONS

1. Field

The present embodiments relate generally to floating structures. More particularly, embodiments relate to methods and apparatus for drilling and production operations on a floating structure.

2. Background

Standard offshore drilling and production practice has been to sequentially prepare wells using a floating vessel with a single drilling platform. Once drilling is finished, the wells are typically placed in a condition for operation. The floating drilling vessel is typically removed and replaced by either a floating production vessel or a fixed production platform. Removing the floating drilling vessel requires complete cessation of drilling activities, lowering of the drilling derricks if necessary, and conducting numerous preparatory tasks prior to moving the floating vessel.

Additional expenses are incurred and time is lost when the floating vessel with an associated drilling rig is required to return to the production well site to perform a workover operation. For example, producing wells may have to be re-completed to produce from a different zone. Such re-completion requires a workover operation that is generally conducted using a drilling rig. As a result, the production facility must be moved and replaced by another vessel equipped a drilling rig order to perform the workover operations.

Less predictable concerns are faced during offshore operations in the open seas where the offshore operation must be able to withstand inclement weather conditions such as extreme wind and wave action and strong currents. Drilling, production, and other submersible equipment used in subarctic and arctic sea operations must be designed to withstand the intense and variable conditions found in these harsh environments. Furthermore, drilling in areas of seasonal ice can limit drilling operations from floating vessels to within approximately a five month window. Thus, it is important that drilling operations conducted from floating vessels be performed with as little interruption as possible.

A need exists, therefore, for floating vessel capable of continuous and/or simultaneous drilling, completions and production.

BRIEF DESCRIPTION OF THE DRAWINGS

The detailed description will be better understood in conjunction with the accompanying drawings as follows.

Figure 1:
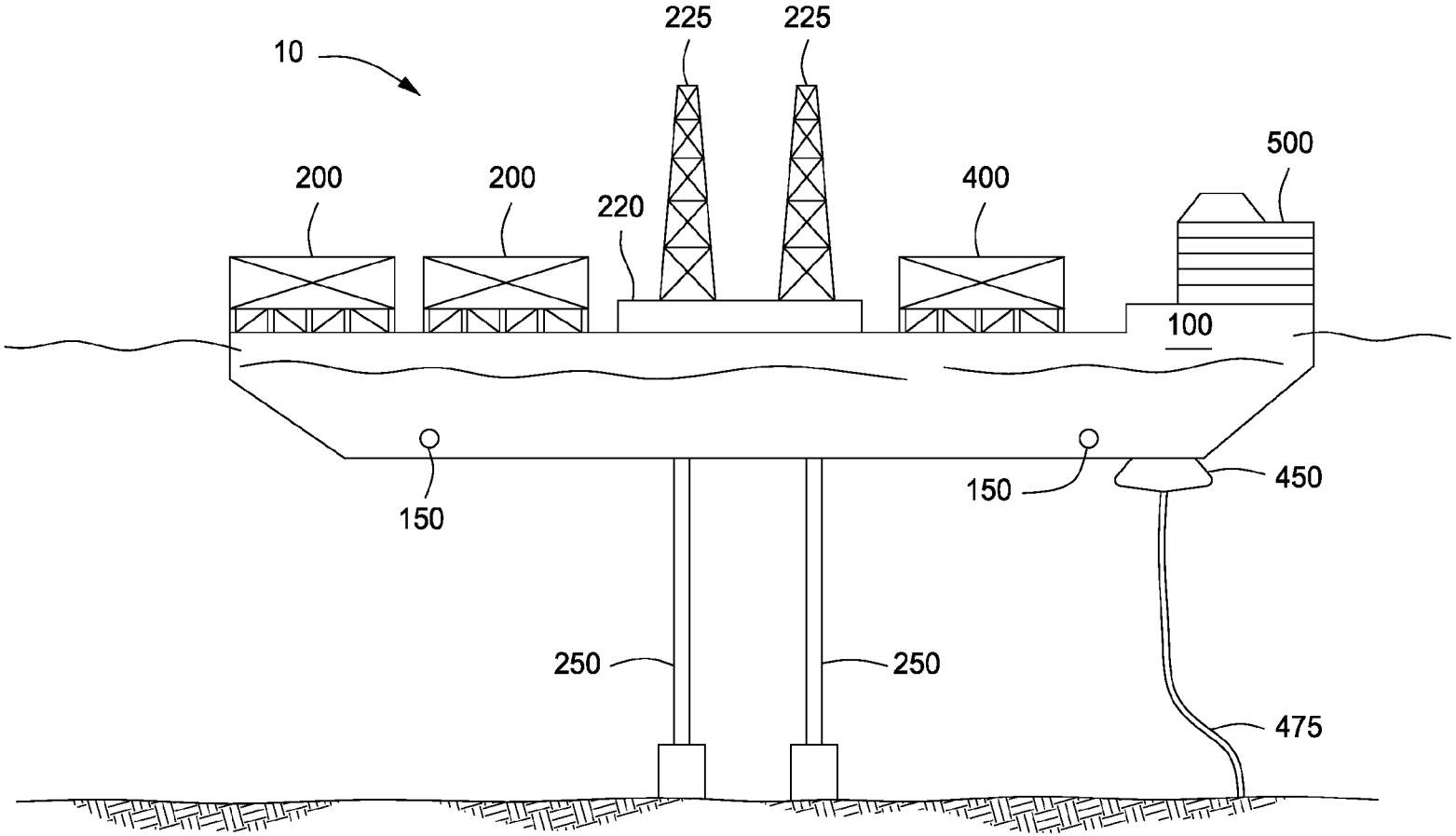
FIG. 1 depicts an illustrative floating unit according to one or more embodiments.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

A multipurpose floating unit is provided. The multipurpose floating unit can have a ship shape or otherwise be characterized as a ship shape floating vessel. In one or more embodiments, the floating unit can be a ship shape floating vessel upon which drilling and production equipment can be disposed. In one or more embodiments, the floating unit can be equipped with drilling and production equipment suitable for carrying out drilling and/or production operations. In one or more embodiments, drilling operations can include well drilling, well completion, well workover, hydrocarbon fluid handling, and subsea manipulation of apparatus useful in drilling including trees, manifolds, wellheads, and jumpers ("drilling operations"). In one or more embodiments, production operations can include production or other hydrocarbon fluid handling, and subsea manipulation of apparatus useful in hydrocarbon production ("production operations"). For example, production operations can include the offloading of produced hydrocarbons to a shuttle tanker. As used herein, the term "subsea" refers to any volume of water in any body of water.

In one or more embodiments, the floating unit can include a hydrocarbon production storage facility disposed thereon or within. In one or more embodiments, the hydrocarbon production storage facility can be an integral part of the unit. In one or more embodiments, the floating unit can include facilities for treating produced hydrocarbons.

In one or more embodiments, the floating unit can be equipped with a detachable production turret. The detachable production turret can allow relatively quick turret removal in case of severe weather or encroaching ice ridges, such as during operation in sub-arctic and arctic seas. The detachable production turret can allow continuous drilling and/or production operations or drilling and/or production operations with minimal interruptions, including drilling and/or production operations in mild ice conditions, also known as thin first year sheet ice. In more severe ice conditions, ice management techniques such as those associated with ice breaking tugs or ships can be employed and still maintain operations. Accordingly, the floating unit can remain on station in extreme subarctic and arctic conditions in shallow to intermediate water depths where ice formation is more frequent or at any water depth.

In one or more embodiments, the floating unit can simultaneously drill and complete at least two wells while producing from at least a third well all while storing the produced hydrocarbons. In at least one specific embodiment, the floating unit can include a ship shape floating vessel having a bow end and a stern end. The ship shape floating vessel can include at least two drilling derricks, at least two drilling modules, and at least one production module, all disposed or otherwise situated on the upper surface of the ship shape floating vessel. The drilling modules can be adapted for conducting drilling operations, and the production module can be adapted for conducting production operations. The ship shape floating vessel can further include at least two marine risers. Each marine riser can depend (i.e. extend or otherwise hang) from a drilling or production module toward a hydrocarbon bearing zone, such as beneath a sea floor, and can be adapted for conducting drilling and/or production operations. A least one production turret can be located on the lower surface of the ship shape floating vessel. At least one production riser can depend from the production turret toward the sea floor and can be adapted for conducting production operations. As used herein, the term "riser" refers to any conduit for housing, carrying or conveying a fluid, tool, or operation therein or there through.

With reference to the figures, FIG. 1 depicts a floating unit according to one or more embodiments. The floating unit 10 can include a ship shape floating vessel 100 upon which can be disposed at least two drilling modules 200, at least two drilling derricks 225, at least two marine risers 250, at least one production module 400, at least one production turret 450, and at least one production riser 475. The ship shape floating unit 10 can include at least two thruster devices 150, each respectively disposed at the bow end and stern end of the ship shape floating vessel 100. In one or more embodiments, the ship shape floating unit can include at least one derrick platform 220 disposed on the ship shape floating vessel 100. In one or more embodiments, the floating unit 10 can include at least one hydrocarbon production storage facility 500. In one or more of the embodiments the floating unit 10 can include one or more living quarters (not shown) to accommodate the crew required for drilling and production operations.

In one or more embodiments, the floating unit 10 can be used for simultaneous drilling and/or production operations. For example, one or more drilling derricks 225 and at least two marine risers 250 can be employed simultaneously with one or more drilling and/or production modules 200, 400 in drilling and/or production operations. In one or more embodiments, either two drilling modules 200, a drilling module 200 and a production module 400, or two production modules 400 can operate simultaneously with the one or more drilling derricks 225 and at least two marine risers 250 to perform drilling and/or production operations. In one or more embodiments, both the production turret 450 and production riser 475 can be employed simultaneously in drilling and/or production operations with drilling and/or production modules 200, 400. In one or more embodiments, any one or more of the drilling derricks 225, marine risers 250, drilling or production modules 200, 400, production turret 450, and production riser 475 can be employed in drilling and/or production simultaneously with the offloading of produced hydrocarbons from the hydrocarbon production storage facility 500. In one or more embodiments, at least one mooring line 485 can be used to anchor the production turret 450 to the ocean or sea floor.

The drilling module 200 and production module 400 can be adapted to conduct drilling and production operations respectively. In one or more embodiments, the drilling and production modules 200, 400 can include equipment associated with drilling and production ("associated equipment") respectively. In one or more embodiments, the associated equipment can be secured to and within the drilling and production modules 200, 400. In one or more embodiments, the associated equipment can be simultaneously removable with the modules as a modular unit when the drilling or production operation has been accomplished. In one or more embodiments, the drilling and production modules 200, 400 can be removably installed on the ship shape floating vessel 100. In one or more embodiments, the drilling and production modules 200, 400 are of a size and arrangement to be interchangeable on the ship shape floating vessel 100. Having interchangeable drilling and production modules 200, 400 allows for flexibility in the drilling and/or production operations of the ship shape floating unit 10 since drilling operations can transition more smoothly to production operations.

Each drilling module 200 can include one or more pipe rack packages, engine packages, living quarters, crane unit for handling pipe and other equipment, sewage treatment plants, liquid storage facilities, active mud tank, mud circulation pumps, cuttings processing facilities, pneumatic tank packages, and cement sack storage facilities. In one or more embodiments, the at least two drilling modules 200 can be employed simultaneously to perform multiple tasks. For example, the at least two drilling modules 200 can be employed in well drilling, well completion, well workover, hydrocarbon fluid handling, and subsea manipulation of apparatus useful in drilling including trees, manifolds, wellheads, and jumpers.

Considering the drilling derricks 225 in more detail, the drilling derricks 225 can be any structure suitable for facilitating drilling and/or production operations including well drilling, well completion, well workover, production or other hydrocarbon fluid handling, and subsea manipulation of apparatus useful in drilling or hydrocarbon production including trees, manifolds, wellheads, and jumpers. In one or more embodiments, the drilling derricks 225 can include a Hallen derrick, a Velle derrick, a Stülcken derrick, or any combination thereof. In one or more embodiments, each drilling derrick 225 can include drilling line, drawworks, a crown block, and a drilling hook. Having the dual drilling derricks 225 can improve the efficiency of the offshore operations. For example, one of the drilling derricks 225 can be making ready to perform the next of a series of operations while the other is performing the preceding operation.

Considering the marine risers 250 in more detail, the marine risers 250 can be any device suitable for effecting hydrocarbon well drilling, well completion, well workover, production, maintenance, hydrocarbon fluid handling, or manipulation of subsea apparatus useful in hydrocarbon drilling and production, including trees, manifolds, wellheads and jumpers. For example, each marine riser 250 can include a longitudinally extending element or riser that can depend from a drilling or production module toward a hydrocarbon bearing zone beneath a river bottom, ocean floor, sea floor, lake floor, or any other body of water. In one or more embodiments, each marine riser 250 can extend from a single drilling derrick 225. In one or more embodiments, each marine riser 250 can include at least one slip and ball joint to decrease risk of marine riser 250 failure due to the pitch and roll of the floating vessel from which it depends or the water in which it is submerged. In one or more embodiments, each marine riser 250 can be a flexible pipe riser. In one or more embodiments, the marine risers 250 can house a drill string or drill pipe, surface or drill casing, drilling fluid, and a drill bit. In one or more embodiments, the marine riser 250 can be attached to a drill template, a wellhead, or a blow out preventer ("BOP"). In one or more embodiments, the marine riser 250 can be a top-tensioned casing with a surface drilling BOP.

Having at least two marine risers 250 can improve the efficiency of offshore operations. For example, a technique for installing a drilling template includes attaching the drilling template to the end of a riser and to lower the drilling template using the draw works of a single drilling derrick. Balancing the drilling template under current, wave, and wind action runs the risk of over stressing and damaging the riser and/or drilling template. Instead, the drilling template can be attached to two risers (i.e. marine risers 250, for example) and the draw works of two drilling derricks 225, thereby significantly increasing the control exercised over the drilling template while reducing the loads born by the marine risers 250. The risk of losing control of the drilling template is accordingly significantly reduced with the simultaneous and coordinated use of a pair of drilling derricks 225 in association with the marine risers 250.

Considering the production module 400 in more detail, each production module 400 can include one or more living quarters; escape modules; beams or walkways; gas; water mixtures; compressors; production fluid treaters; production facilities packages including a flare tower, a compressor a crane, and a beam or walkway; gas meters; pig launchers/receivers; monorails for pig launcher/receivers; sewage treatment plants; overhead cranes; safe welding areas; air compressors; salt water pumps; sumps; volumetric measuring and recording devices; generator facilities; wet oil pumps; wet/dry oil tanks; pipeline pumps; areas for future pipeline pumps; well manifolds; wellheads; and heliports. In one or more embodiments, the production module 400 can include a facilities skid of equipment for separating and/or treating oil; heat medium equipment; utility equipment; a utility equipment skid; water flooding equipment; gas lift equipment; and helicopter fuel. In one or more embodiments, at least two production modules 400 can be employed simultaneously in any of the following activities: production or other hydrocarbon fluid handling and subsea manipulation of apparatus useful in hydrocarbon production.

Equipment associated with the production module 400 can be used to produce hydrocarbons from a production well; treat the produced hydrocarbons with production fluid treaters; and offload the produced hydrocarbons to an offshore storage facility, a shuttle tanker, or directly to a hydrocarbon production storage facility located within the ship shape floating vessel 100. In one or more embodiments, treating the produced hydrocarbons can include separating oil and gas mixtures, oil and water mixtures, removing contaminants from the produced hydrocarbons, or any combination thereof.

Considering the production turret 450 in more detail, each production turret 450 can include any turret suitable for transferring well fluids, controls, and mooring loads to the ship shape floating vessel 100. In one or more embodiments, the production turret 450 can include any turret suitable for use in floating vessel hydrocarbon production including a turret installed inside the vessel hull or outside the vessel hull. For example, the production turret 450 can be located forward of the bow or between the stern and the bow of the ship shape floating vessel 100. In one or more embodiments, the production turret 450 can be connected to the ship shape floating vessel 100 by an articulating yoke. In one or more embodiments, the production turret 450 can have passive or active rotation. The production turret 450 can be equipped with a fluid swivel. In one or more embodiments, the fluid swivel can enable tie-back and re-injection of produced gas and 360° weather vaning of the ship shape vessel 100 about the vertical axis of the production turret 450. In one or more embodiments, the production turret 450 can include at least one turntable or turret transfer system.

In one or more embodiments, the production turret 450 can be a detachable turret. For example, the detachable turret can include a lower radial sliding bearing with a relatively small width and large diameter and an upper spherical axial bearing with a relatively smaller diameter wherein the turret can be disconnected from the upper spherical bearing by a multiple thread, non-selflocking screw connection between a sleeve and a hub. The lower bearing can be designed to only take horizontal force and fitted in the area where the horizontal component of the anchor mooring forces are acting, thereby insuring that almost only axial forces can be transferred further to the upper bearing where also the coupling mechanism can be fitted. When in connected position, the detachable turret is locked by a dog clutch. When disconnected, the detachable turret can sink to a stable equilibrium distance below the surface of the ocean.

Considering the production riser 475 in more detail, each production riser 475 can be any device suitable for effecting hydrocarbon production, hydrocarbon fluid handling, maintenance, or manipulation of subsea apparatus useful in hydrocarbon drilling and production, including trees, manifolds, wellheads and jumpers. For example, the production riser 475 can include a longitudinally extending element or riser that depends from a production turret toward a hydrocarbon bearing zone beneath a river, ocean, sea, or lake floor.

In one or more embodiments, the production riser 475 can include flexible joints intermediate the production riser ends to increase flexibility of production riser 475 and decrease failure of production riser 475 due to wind, wave, and current forces. This is especially true in shallow to intermediate water depths where wind, wave, and current action are exaggerated.

In one or more embodiments, at least two, three, four, or five production risers 475 can depend from the production turret 450 and terminate on any one of a number of subsea systems, including manifolds, well heads, and well head assemblies. In one or more embodiments, each production riser 475 can be attached to the upper portion of the production turret 450. In one or more embodiments, hydrocarbon fluid transfer can be accomplished via the production turret 450 using a multi-path high-pressure swivel. In one or more embodiments, each production riser 475 can remain fixed as the ship shape floating vessel 100 weather vanes about the production turret 450.

Considering the hydrocarbon production storage facility 500 in more detail, each hydrocarbon production storage facility 500 can include at least one hydrocarbon production storage vessel. In one or more embodiments, the hydrocarbon storage facility 500 can store produced hydrocarbon liquids, hydrocarbon gases, drilling liquids, sea water ballast or any combination thereof. In one or more embodiments, the hydrocarbon storage facility 500 can be disposed within the ship shape floating vessel 100. In one or more embodiments, the hydrocarbon storage facility 500 can be an integral part of the ship shape floating vessel 100. For example, the hydrocarbon storage facility 500 can be the storage hull of a FPSO type ship shape floating vessel 100.

Considering the ship shape floating vessel 100 in more detail, the ship shape floating vessel 100 can include any self-propelled, ship shape floating vessel suitable for performing hydrocarbon production activities such as drilling, production, storage, and offloading. In one or more embodiments, the ship shape floating vessel 100 is or can include a ship, a semi-submersible, a drill ship, a floating production unit or vessel ("FP"), floating production offloading unit of vesel ("FPO") or a floating, production, storage and offloading unit or vessel ("FPSO").

Considering the thrusters 150 in more detail, each thruster 150 can be any thruster suitable for propelling or maneuvering a floating vessel in a subsea environment. In one or more embodiments, the thruster 150 can be a selectively actuable and rotatable motive unit for guiding and propelling the ship shape floating unit 10 in a coordinated manner. For example, each thruster 150 can include a propeller, water turbine, rudder, impeller, azimuth thruster including a Z-drive, bow thruster, or any combination thereof. In one or more embodiments, the thrusters 150 can operate to accomplish station keeping, attitude control, and/or long duration low thrust acceleration.

Figure 2:
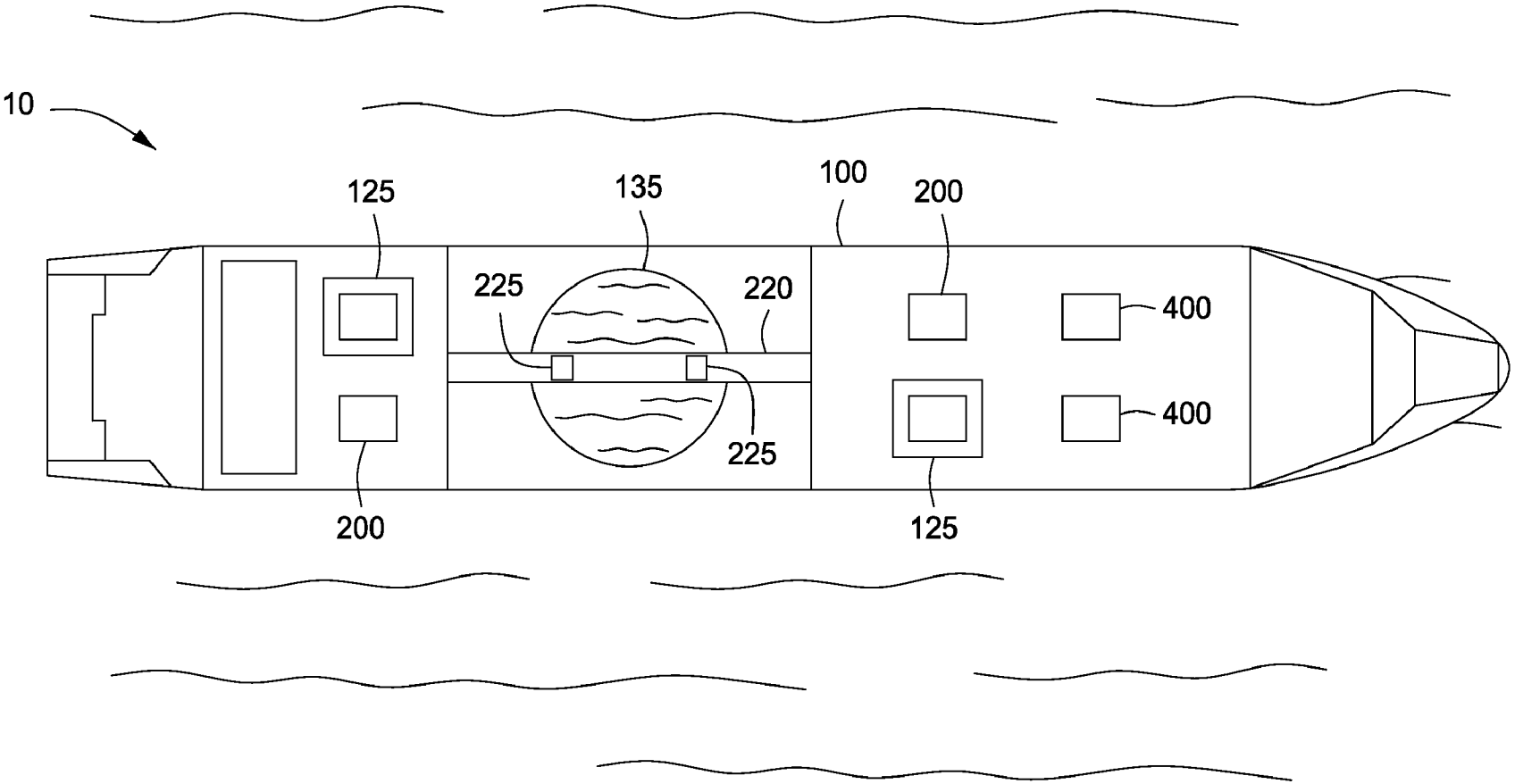
FIG. 2 depicts a top view of an illustrative floating unit according to one or more embodiments.

FIG. 2 depicts a top view of an illustrative ship shape floating unit according to one or more embodiments. In one or more embodiments, the ship shape floating vessel 100 of the ship shape floating unit 10 can include a structural frame defining a plurality of bays 125 into which drilling and/or production modules 200, 400 can be selectively inserted. In one or more embodiments, the ship shape floating vessel 100 can have a structural frame adapted to accommodate the removable installation of at least two drilling modules 200 and at least one production module 400. The structural frame of the ship shape floating vessel 100 can be designed such that a drilling module 200 and/or production module 400 can be installed or removed into the bays 125 without affecting the structural integrity of the structural frame or the ship shape floating vessel 100.

In one or more embodiments, the ship shape floating vessel 100 can include one or more moon pools 135 through which the at least two marine risers 250 can extend from the derricks 225 to the ocean floor. The moon pool 135 can be any shape or size suitable to facilitate drilling operations and the operation of the marine risers 250. The moon pool 135 can extend from the upper surface of the ship shape floating vessel 100 to the bottom surface of the ship shape floating vessel such that the ocean water can be viewed from an upper surface of the ship shape floating vessel.

Each derrick platform 220 can be any structure suitable for supporting at least one drilling derrick 225. In one or more embodiments, the derrick platform 220 can support drilling and production personnel. In one or more embodiments, the derrick platform 220 can support one or more derricks 225 and associated drilling and/or production equipment. For example, the derrick platform 220 can support at least one derrick 225, pipe string, and a drill bit. The derrick platform 220 can be any shape or size. For example, the derrick platform 220 can be square, round, rectangular, triangular, or hexagonal. The derrick platform 220 can be made of any material suitable for supporting at least one derrick 225. In one or more embodiments, the derrick platform 220 can be at least partially suspended over an operating throughway or "moon pool" 135. In one or more embodiments, the derrick platform 220 can support at least one derrick 225 over the moon pool 135. In one or more embodiments, the derrick platform 220 can support two or more derricks 225 over a moon pool 135.

Figure 3:
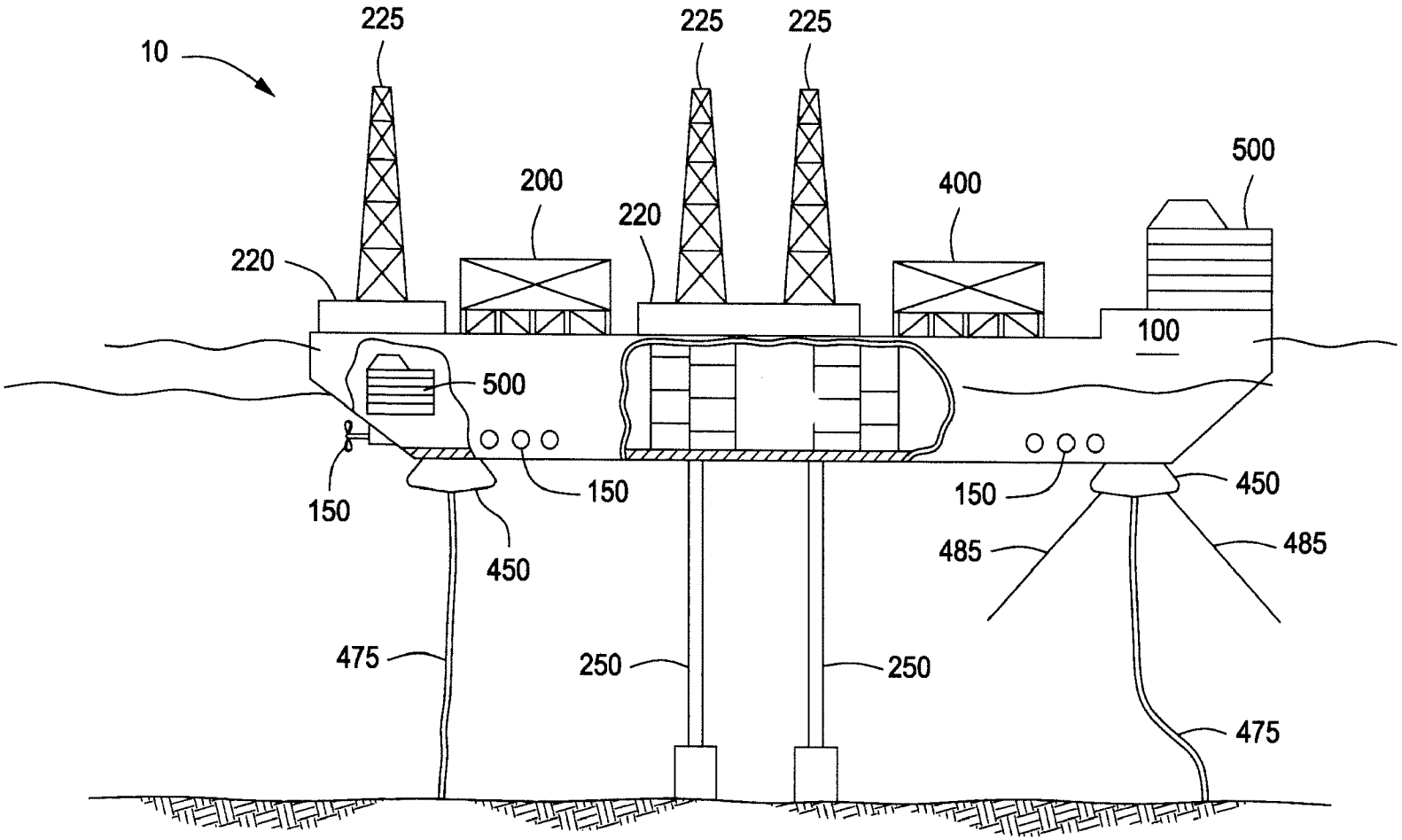
FIG. 3 depicts a partial cut-away view of an illustrative floating unit according to one or more embodiments.

FIG. 3 depicts a partial cut-away view of an illustrative ship shape floating unit 10 according to one or more embodiments. In one or more embodiments, the ship shape floating vessel 100 can be ice strengthened. For example, the ship shape floating unit 10 can have a double hull with a gap between the hulls where the gap can be air or water filled; a flat hull shape with a rounded rather than pointed bow which can allow the front of the ship to drive forwards, rise above the ice and then let the weight of the ship break the ice; or a reinforced "ice belt" that typically extends about 1 m above and below the water line.

In one or more embodiments, the floating unit 10 can include one or more mooring lines 485, such as three or more, attached to the production turret 450 of the ship shape floating vessel 100. The mooring lines 485 can be used to moor the ship shape floating vessel 100 over a particular well site. In one or more embodiments, the mooring lines 485 can be attached to the lower portion of the production turret 450. An illustrative mooring line 485 can include two or more miles of between 4 and 6-inch diameter line of chain and wire combinations. In one or more embodiments, the length of the mooring line 485 can be about 2 to 3 times the water depth. The mooring line 485 can be anchored to the ocean or sea floor. In one or more embodiments, the production turret 450 can be connected to at least one production riser 475 and at least one mooring line 485.

Figure 4:
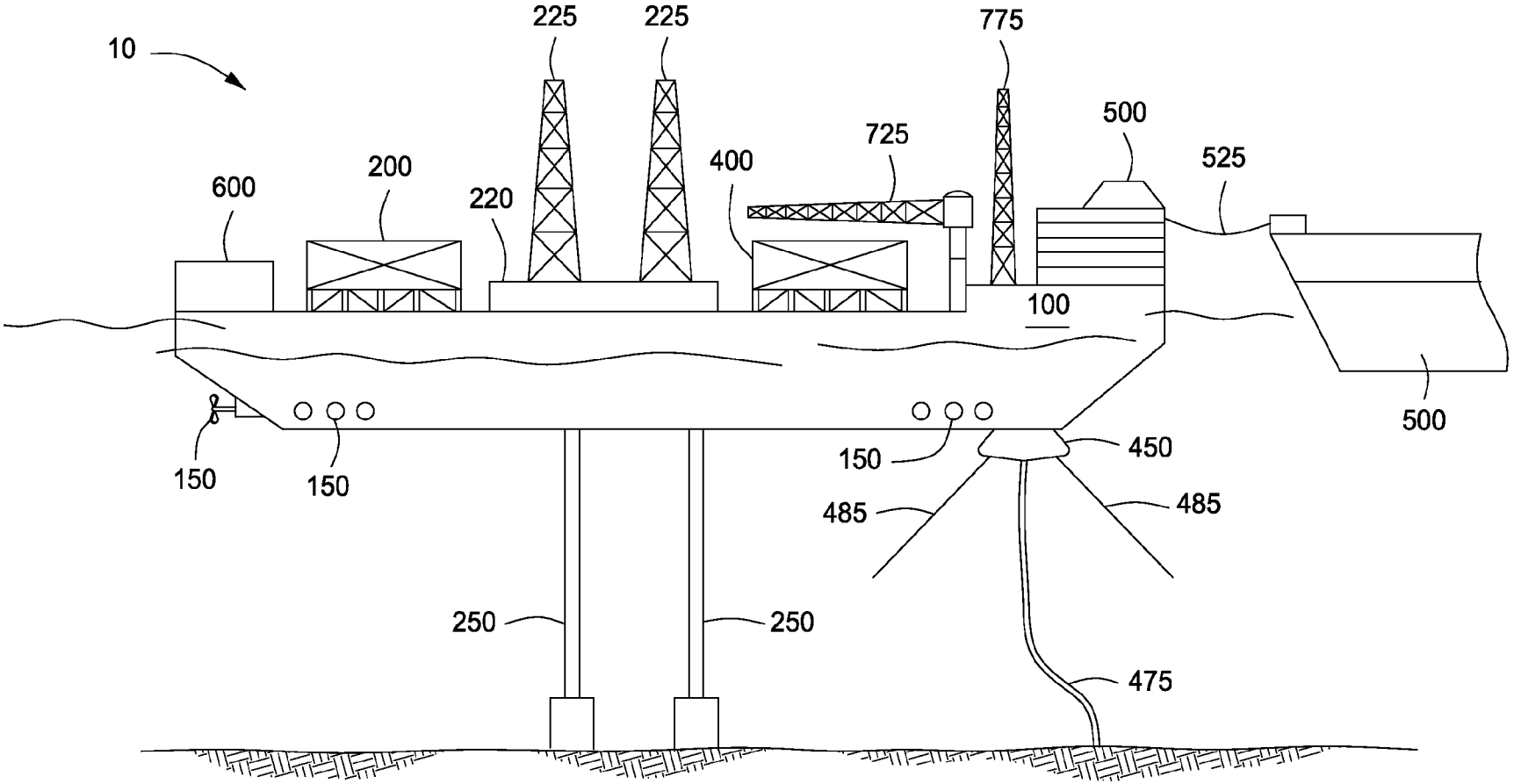
FIG. 4 depicts an illustrative floating unit configured for offloading produced hydrocarbons according to one or more embodiments.

FIG. 4 depicts an illustrative ship shape floating unit configured for offloading produced hydrocarbons according to one or more embodiments. In one or more embodiments, the hydrocarbon production storage facility 500 can be a shuttle tanker. For example, produced hydrocarbons can be produced via the production riser 475 and offloaded from the multipurpose ship shape floating vessel 100 to the hydrocarbon production storage facility 500 via a produced hydrocarbons fluid transfer hose. For example, offloading produced hydrocarbons from the ship shape floating vessel 100 to a shuttle tanker can be accomplished via a hawser hose.

In one or more embodiments, the ship shape floating unit 10 can include one or more personnel housing facilities 600 disposed on the ship shape floating vessel 100. The personnel housing facilities 600 can be any shape and size suitable for housing personnel over temporary or long term stays. For example, the personnel housing facilities 600 can have a size sufficient to house ship shape floating unit 10 personnel for 3 days, 10 days, 21 days, 30 days, 60 days, or more. In one or more embodiments, the personnel housing facilities 600 can have a size sufficient to house drilling and production operations personnel used for maximum equipment operating capacity.

In one or more embodiments, the ship shape floating unit 10 can include one or more cranes 725 disposed on the uppers surface of the ship shape floating vessel 100. The one or more cranes 725 can be any device suitable for facilitating the lifting, transport, and placement of drilling and/or operating equipment between support ships and the ship shape floating vessel 100 and/or upon the ship shape floating vessel 100. In one or more embodiments, the crane 725 can lift, transport, and place pipe string, drill templates, blow out preventers, and drill heads. In one or more embodiments, one or more cranes 725 can be included as a part of the drilling module 200. In one or more embodiments, the production module 400 can include one or more cranes 725.

In one or more embodiments, the ship shape floating unit 10 can include one or more flares 775 disposed upon an upper surface of the ship shape floating vessel 100. The flare 775 can be any device suitable for burning off hydrocarbons produced from drilling and/or production operations of the ship shape floating vessel 100. In one or more embodiments, the flare 775 can be included in the production module 400.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

What is claimed is:

1. A floating unit for conducting simultaneous drilling and production, comprising:

a vessel having a bow end and a stern end, wherein the vessel includes at least two drilling derricks, at least two drilling modules, and at least one production module, all disposed on an upper surface thereof, such that the floating unit can simultaneously drill through use of the at least two drilling derricks and the at least two drilling modules, complete at least two wells while producing from a third well, and store the produced hydrocarbons, and wherein the bow end includes a hull which is strengthened for breaking ice;

at least two marine risers, wherein each marine riser depends from any one or more of the drilling or production modules and extends toward a water bottom;

a hydrocarbon production storage facility;

at least one production turret located on a lower surface of the vessel; and at least one production riser depending from the production turret, toward a hydrocarbon bearing zone.

2. The floating unit of claim 1, wherein the production turret is equipped with a fluid swivel.

3. The floating unit of claim 1, wherein any one or more of the marine and production risers are for well drilling, well completion, well workover, hydrocarbon fluid handling, or subsea manipulation of apparatus for drilling.

4. The floating unit of claim 1, wherein any one or more of the marine and production risers are for production or other hydrocarbon fluid handling and subsea manipulation of apparatus useful in hydrocarbon production.

5. The floating unit of claim 1, wherein the production modules are sized and arranged to be interchangeable with drilling modules when drilling operations have been completed.

6. The floating unit of claim 1, wherein the floating vessel has a structural frame to accommodate the removable installation of the drilling modules and the production modules.

7. The floating unit of claim 1, wherein the floating vessel has a structural frame defining a plurality of bays into which the drilling and production modules are selectively inserted.

8. The floating unit of claim 1, further comprising at least two thrusters, wherein at least one thruster is disposed at the bow end and at least one thruster is disposed at the stern end of the floating vessel.

9. The floating unit of claim 1, further comprising offloading facilities for offloading produced hydrocarbons from a subsea well.

10. A floating unit for use in extended operations as a drilling, production, storage and offloading platform, comprising:

a ship shape floating vessel having a stern end and a bow end, wherein the bow end includes a hull which is strengthened for breaking ice;

two drilling derricks, two drilling modules, and a production module all situated on the upper surface of the ship shape floating vessel such that the floating unit can simultaneously drill through use of the at least two drilling derricks and the at least two drilling modules, complete at least two wells while producing from a third well, and store the produced hydrocarbons, wherein the drilling modules are for conducting drilling operations, wherein the production module is for conducting production operations;

two marine risers each depending from a single drilling or production module and extending from a single drilling derrick, wherein the marine risers are for conducting drilling and production operations;

a first thruster located at the stern end and a second thruster located at the bow end of the ship shape floating vessel;

a main thruster located at the stern end of the ship shape floating vessel;

a production turret, including a production riser, located on the bottom surface of the ship shape floating vessel;

a vent stack and a crane each located on the upper surface of the ship shape floating vessel; and a hydrocarbon production storage facility located within the ship shape floating vessel.

11. The floating unit of claim 10, wherein the production turret comprises a fluid swivel.

12. The floating unit of claim 10, wherein the production turret is detachable.

13. The floating unit of claim 10, wherein the ship shape floating vessel has a structural frame defining a plurality of bays into which the drilling and production modules are selectively inserted.

14. The floating unit of claim 10, wherein the ship shape floating vessel has a structural frame to accommodate the removable installation of the drilling modules and the production module.

15. The floating unit of claim 10, wherein the production module is sized and arranged to be interchangeable with the drilling modules.

16. The floating unit of claim 10, wherein the drilling operations include well drilling, well completion, well workover, hydrocarbon fluid handling, or subsea manipulation of apparatus useful in drilling including trees, manifolds, wellheads, and jumpers.

17. The floating unit of claim 10, wherein the production operations include production or other hydrocarbon fluid handling and subsea manipulation of apparatus useful in hydrocarbon production.

18. The floating unit of claim 10, further comprising offloading facilities for offloading produced hydrocarbons from a subsea well.

* * * * *